United States Patent [19]

Kawai et al.

[11] Patent Number: 4,671,337

[45] Date of Patent: Jun. 9, 1987

[54] FORCED COOLING CASTING APPARATUS

[75] Inventors: Hiroshi Kawai; Yukio Otsuka, both of Toyota, Japan

[73] Assignee: Toyota Jidosha Kabushiki Kaisha, Toyota, Japan

[21] Appl. No.: 853,721

[22] Filed: Apr. 18, 1986

[51] Int. Cl.[4] ..... B22D 27/04

[52] U.S. Cl. ..... 164/150; 164/339; 164/342; 164/348

[58] Field of Search ..... 164/348, 126, 128, 4.1, 164/458, 150, 339, 342

[56] References Cited

U.S. PATENT DOCUMENTS

| | | | |
|---|---|---|---|
| 2,110,360 | 3/1938 | Fisher | 164/348 X |
| 3,590,904 | 7/1971 | Woodburn, Jr. | 164/348 X |
| 4,585,047 | 4/1986 | Kawai et al. | 164/348 X |

*Primary Examiner*—Nicholas P. Godici

*Assistant Examiner*—J. Reed Batten, Jr.

*Attorney, Agent, or Firm*—Oblon, Fisher, Spivak, McClelland & Maier

[57] ABSTRACT

A lower mold made of a metal mold is disposed on a stool and an upper mold consisting of a sand mold is guided and fitted to the lower mold in such a manner as to define a cavity for a product. Tubular members are disposed at several positions in such a manner as to penetrate through the upper and lower molds and the cavity. A cooling plate equipped with cooling nozzles fitting to the projecting ends of the tubular members from the upper mold is disposed in such a manner as to clamp the upper and lower molds between it and the stool. The cooling nozzles are communicated with a cooling medium tube disposed on the cooling plate so that a cooling medium supplied to the cooling medium tube is uniformly distributed to the cooling nozzles.

15 Claims, 20 Drawing Figures

FORCED COOLING CASTING APPARATUS

BACKGROUND OF THE INVENTION

1. Field of the Invention

This invention relates to a forced cooling casting apparatus for causing directional solidification by use of a cooling medium.

2. Description of the Related Art

Various measures for rapidly cooling a molten metal or for causing directional solidification have been employed in the past in order to produce castings made of an aluminum alloy or the like without casting defects resulting from casting processes. For instance, water cooling and air cooling have been used primarily in a gravitational casting method and a low pressure casting method in order to promote the solidification of the molten metal. In accordance with these conventional cooling methods, however, supercooling of the molten metal is likely to occur so that an inferior run is likely to occur at the time of pouring the molten metal or a mold temperature changes periodically during a casting cycle. As a result, a high level of skill is necessary to control the mold temperature, or a casting apparatus becomes complicated in construction and requires a higher cost of production.

To eliminate the problem described above, there has been proposed a direct cooling type casting method (Japanese Published Patent Application No. 109559/1982) which can accomplish efficiently and rapidly the intended directional solidification and can provide excellent castings free from any defects and having high mechanical strength without being limited by the dimension and size of castings. This technique provides the excellent effects that the casting cycle can be shortened and the mechanical strength of the resulting castings can be improved.

In accordance with the method described above, however, sufficient directional solidification cannot be obtained from time to time when the size of intended castings is as large as a cylinder head of a car. For this reason, the applicants proposed a forced cooling type casting method which improves directional solidification by incorporating tubular members in a cavity for products and passing a cooling medium through the tubular members (Japanese Published Patent Application No. 86966/1983. See also U.S. patent application Ser. No. 814,929, filed on Dec. 30, 1985 and U.S. patent application Ser. No. 853,722 having the same filing date as the present application and entitled "FORCED COOLING CONTINUOUS CASTING APPARATUS", the subject matter of both of which is incorporated herein by reference.)

Recently, a cooling method has been developed which divides the period from a molten metal charging step to a complete solidification of products into a plurality of stations and cools the products step-wise in order to fulfill the requirements for a shorter casting cycle due to an increasing dimension of castings, and in order to improve producibility. According to this method, a casting apparatus is conveyed as a whole on a track by rollers and is subjected to the cooling step at each station.

However, the following disadvantages occur in accordance with the technique described above.

In order to rapidly cause suitable directional solidification while taking into consideration the shape of large castings when casting them, a plurality of tubular members must be incorporated into the casting and at the same time, a plurality of cooling medium feeders must also be disposed in order to pass a cooling medium such as water through the tubular members. Therefore, the system becomes more complicated in construction, and must be disposed at each station. Thus, the overall system becomes larger and more expensive.

SUMMARY OF THE INVENTION

It is therefore an object of the present invention to provide a forced cooling casting apparatus having a construction in which a lower mold consisting of a metal mold is disposed on a stool which is movable by rollers or the like; an upper mold consisting of a sand mold is guided and fitted to the lower mold in such a manner as to define a cavity for a product; tubular members penetrating through the cavity and the upper and lower molds are disposed at a plurality of positions; a cooling plate having cooling nozzles that fit to the projecting ends of the tubular members from the upper mold is disposed in such a manner as to clamp the upper and lower molds between it and the stool; and the cooling nozzles are communicated with one cooling medium tube disposed on the cooling plate so that a cooling medium supplied to the cooling medium tube is uniformly distributed to the cooling nozzles.

It is another object of the present invention to provide a forced cooling casting apparatus wherein the center portion of the stool described above is punched out, and the cooling medium is jetted to the lower mold exposed within the punch-out range of the stool in order to cool the lower mold and to promote directional solidification.

It is still another object of the present invention to provide an abnormality detector which detects an abnormal setting that occurs when the cooling nozzles of the cooling plate are not correctly fitted to the tubular members inserted into the molds when the cooling plate is disposed for forced cooling of the poured molten metal, and senses also an abnormal setting of the cooling plate itself.

In the forced cooling casting apparatus in accordance with the present invention, when the cooling plate equipped with a plurality of cooling nozzles corresponding to a plurality of tubular members fitted to the upper and lower molds and through the cavity is fixed to the stool, the cooling nozzles are fitted to the tubular members and are communicated with a cooling medium tube having a cooling medium coupler. Jet water is also jetted from a cooling medium jet device disposed below the punch-out portion of the stool to the lower mold. The cooling medium sent from a cooling medium feeder connected to the cooling medium coupler is jetted from each cooling nozzle to the molten metal through each tubular member so as to forcedly cool the molten metal. Directional solidification is effectively carried out from the lower mold side to the molten metal side.

The cooling medium feeder connected to each cooling medium coupler is disposed on a casting line main body, at which the casting apparatus holding the cooling plate stops, and is detachably fitted to the cooling medium coupler of each cooling plate. Furthermore, it is possible in the present invention to check in advance whether or not the cooling plate is correctly set and whether or not the tip of each cooling nozzle fits to the projecting end of the corresponding tubular member when the cooling plate is disposed on the stool.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIGS. 17 through 20 show sensing modes of an abnormal fitting detector, wherein FIG. 17 shows a normal state and FIGS. 18 through 20 show the state of sensing an abnormality.

DESCRIPTION OF THE PREFERRED EMBODIMENTS

The construction of the present invention will now be described with reference to the preferred embodiment shown in the accompanying drawings.

Figure 1:
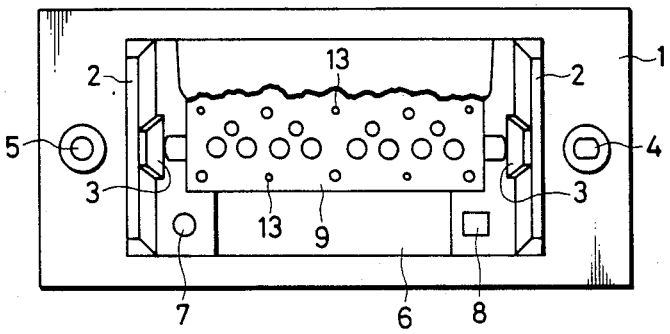
FIG. 1 is a partial exploded plan view showing a lower mold placed on a stool.
Figure 2:
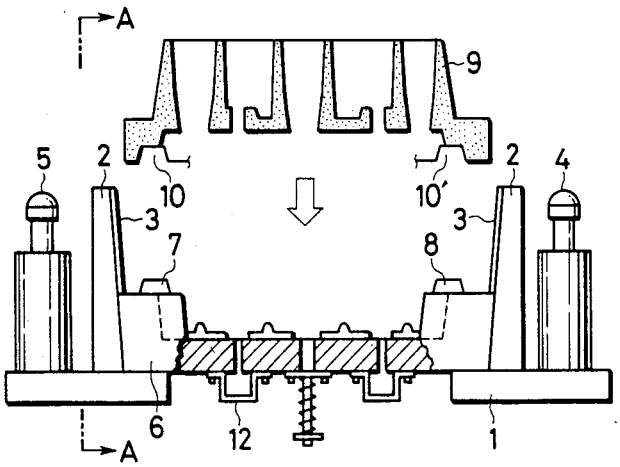
FIG. 2 is a partial exploded side view of a casting apparatus before an upper mold is fitted.
Figure 3:
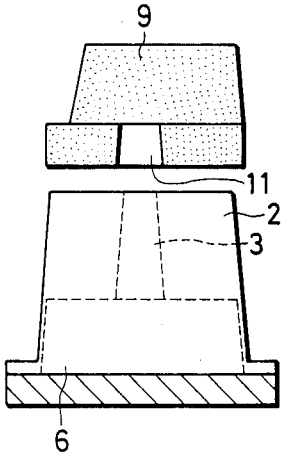
FIG. 3 is a sectional view taken along line A—A of FIG. 2.
Figure 4:
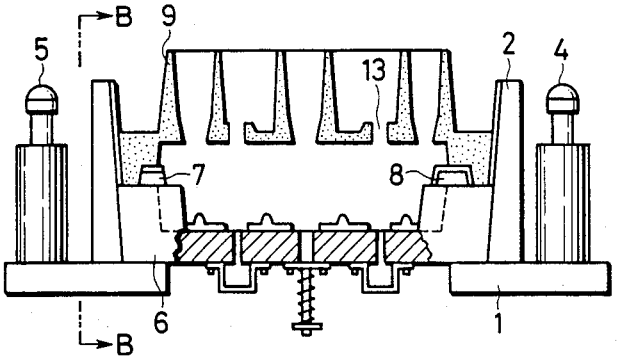
FIG. 4 is a partial exploded side view of the apparatus after the upper mold is fitted.
Figure 5:
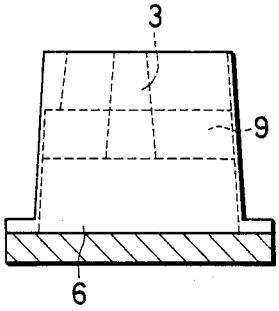
FIG. 5 is a sectional view taken along line B—B of FIG. 4.

FIGS. 1 through 7 shows the fitting state of molds in the apparatus of the present invention. Reference numeral 1 represents a stool which is punched out, and reference numeral 2 represents a pair of taper cases which extend from the right and left ends of a lower mold 6 and are integral therewith. As depicted in FIG. 2, the opposed surfaces of the lower mold taper cases open upward for guiding an upper mold 9, and a case guide 3 consisting of a projection on each opposed surface whose width increases progressively downward is disposed in a vertical direction at the longitudinal center line of the lower mold. Reference numerals 4 and 5 represent guide pins for guiding guide bushes 21 and 22 disposed below both ends of a cooling plate 19.

Figure 6:
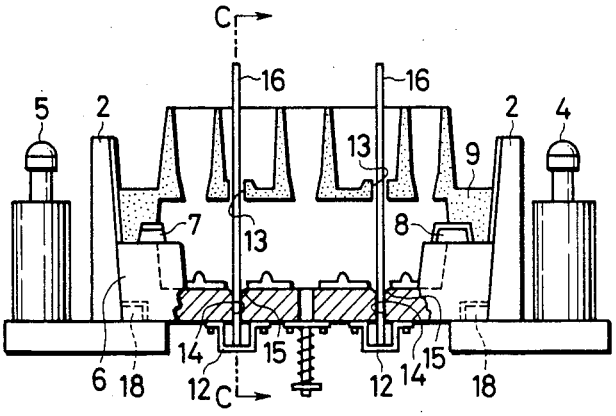
FIG. 6 is a partial exploded side view of the apparatus when a tubular member is inserted.

The lower mold 6 is fixed to the stool 1 by a key 18 shown in FIG. 6, and reference numerals 7 and 8 represent round and square dowels, respectively. These dowels respectively fit into a round recess 10 and a square recess 10' disposed at corresponding positions of the upper mold, when the upper and lower molds are put together. The relation between the square dowel and the square recess is such that play is formed in a longitudinal direction of the mold. Therefore, they absorb the thermal extension and warp of the mold in its longitudinal direction.

Reference numeral 11 represents a guide groove disposed on the side surface of the upper mold 9. When the upper mold 9 is set onto the lower mold 6, the case guide 3 equipped with the taper that expands progressively downward is fitted to this guide groove 11 and the upper mold is gradually fitted to the lower mold. This guide groove 11 serves as the guide till the relation of position between the upper and lower molds is determined in both transverse and longitudinal directions by the round and square dowels 7, 8 fitting to the round and square recesses 10, 10', respectively.

Figure 7:
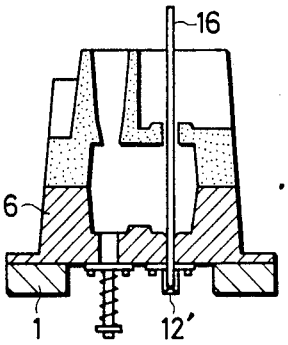
FIG. 7 is a sectional view taken along line C—C of FIG. 6.
Figure 8:
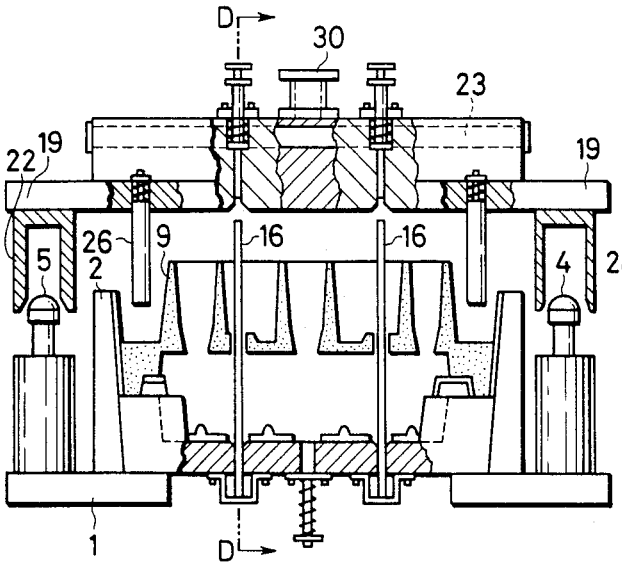
FIG. 8 is a partial exploded side view of the apparatus before a cooling plate is fitted.

Reference numeral 12 represents a tubular member receiver. As shown in FIG. 7, a receiving bed 12' prevents the tubular member from falling before the solidification of the molten metal and receives the lower end of the tubular member at its apex which has a triangular sectional shape. When a cooling medium is discharged from the tubular member, it is discharged while being deflected to the right and left.

Reference numeral 13 represents a hole for the tubular member bored in the upper mold. Each hole roughly supports the tubular member 16 and corresponds to a hole 14 for the tubular member bored in the lower mold 6. Reference numeral 15 represents a taper portion for making it easy to insert the tubular member 16 from above into the lower mold. This taper portion is formed around the hole 14.

FIGS. 8 through 13 show the state in which a cooling plate 19 is put on the stool using the guide pins 4 and 5 after the tubular member 16 is fitted as shown in FIG. 6.

In the drawings, reference numeral 20 represents cooling nozzle holes that are bored at an increased thickness portion at the center of the cooling plate 19 in such a manner as to correspond to a plurality of the tubular members 16, respectively. A cooling nozzle 24 is disposed in each of these holes while being urged by a spring 25 in the direction of the tubular members. A tapered surface 17 having a diameter greater than that of the tubular member hole 13, which is bored in the upper mold, is formed around the periphery of each cooling nozzle hole 20 on the side of the upper mold so that the tip of the tubular member is guided into the hole 20 before the cooling plate is lowered and the tip of the cooling nozzle is inserted into the tubular member. When the tip of the cooling nozzle is inserted into the projecting end of the tubular member 16, a suitable push margin is provided between them so that the spring 25 can push the cooling nozzle 24 towards the tubular member 16 by suitable spring force. Thus, when the molten metal is poured, the tubular member does not float up and when the cooling medium is charged, it does not leak from the joint between the nozzle 24 and the tubular member 16.

The spring 25 is held in the main body of the cooling plate and is not exposed to external heat, dust and moisture. Therefore, rust does not develop and the spring has long service life. In addition, the space on the upper surface of the cooling plate can be effectively utilized, such as for the disposition of a cooling medium tube.

Reference numerals 21 and 22 represent bushes that are disposed below the right and left ends of the cooling plate 19. The bush 21 is tightly fitted to the guide pin 4 while the bush 22 is loosely fitted to the guide pin 5 in the longitudinal direction of the casting mold. Reference numeral 23 represents a cooling medium tube formed at the increased thickness portion of the cooling plate 19 and extending in its longitudinal direction, and both ends of the tube are sealed by suitable means. Reference numeral 26 represents a mold support disposed on the cooling plate and urged by a spring 27 in the mold direction. The force of this spring is smaller than the total load of the cooling plate.

Figure 12:
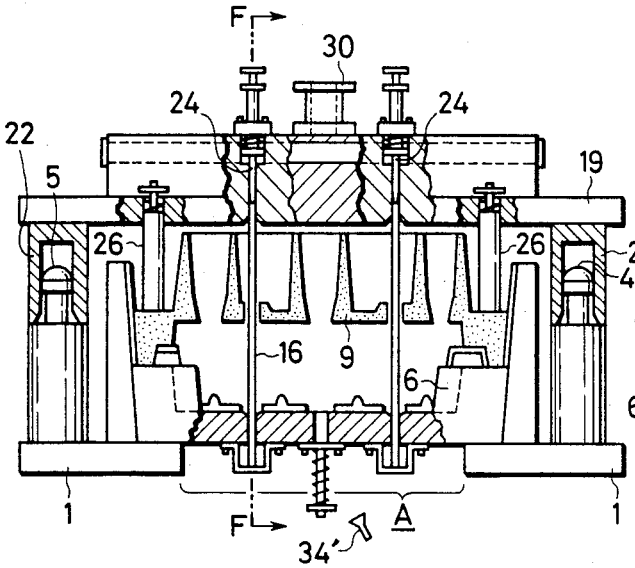
FIG. 12 is a partial exploded side view of the apparatus when the cooling plate is completely fitted.
Figure 13:
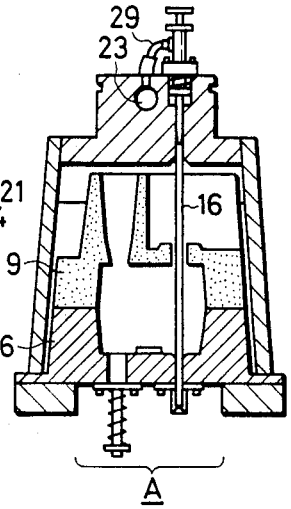
FIG. 13 is a sectional view taken along line F—F of FIG. 12.
Figure 14:
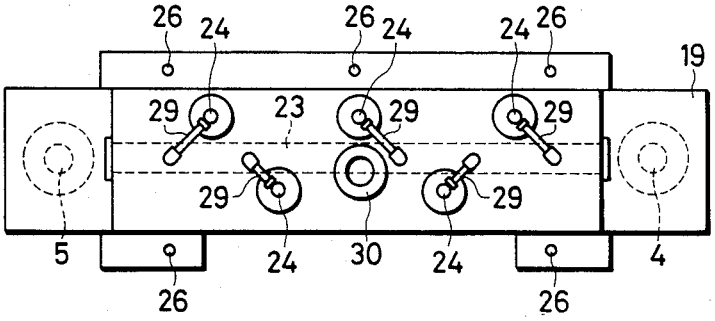
FIG. 14 is a plan view of the cooling plate.

FIG. 12 shows the state in which the cooling plate 19 is fully lowered, the mold support 26 supports the upper and lower molds by the spring 27 and the tip of each cooling nozzle 24 is fitted into a tubular member. In FIG. 13 which is a sectional view taken along line F—F of FIG. 12 and in FIG. 14 which is a plan view of the cooling plate, the cooling medium tube 23 is shown communicated with each cooling nozzle 24 by a connection tube 29. Reference numeral 30 represents a cooling medium coupler, which is connected to the cooling medium feeder 31 shown in FIG. 15. The feeder 31 introduces the cooling medium into the cooling medium tube and causes the cooling medium to flow into the tubular members from each cooling nozzle 24.

Figure 16:
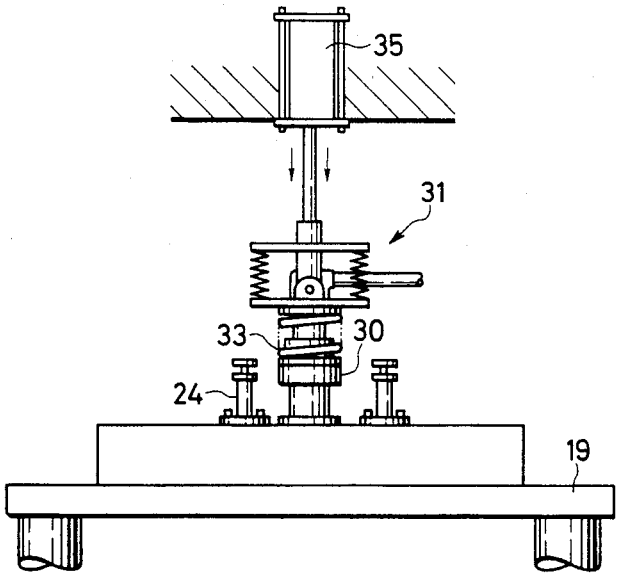
FIG. 16 is a schematic view showing the state in which the cooling medium feeder and the cooling plate are connected to each other.

FIG. 16 shows the connection state between the cooling medium feeder 31 and the cooling medium coupler 30. Reference numeral 32 represents an orifice member, 33 is a spring which urges the orifice member 32 toward the cooling medium coupler 30, 34 is a cooling medium feeder tube and 35 is a cylinder which is disposed on a casting line main body mechanism and has a piston connected to the cooling medium feeder in order to move the cooling medium feeder as a whole towards the cooling plate. Ihe cylinder attaches and removes the orifice member to and from the cooling medium coupler 30.

Figure 9:
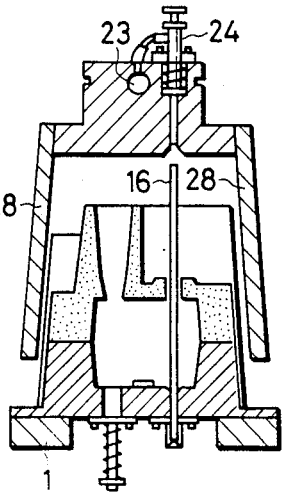
FIG. 9 is a sectional view taken along line D—D of FIG. 8.
Figure 10:
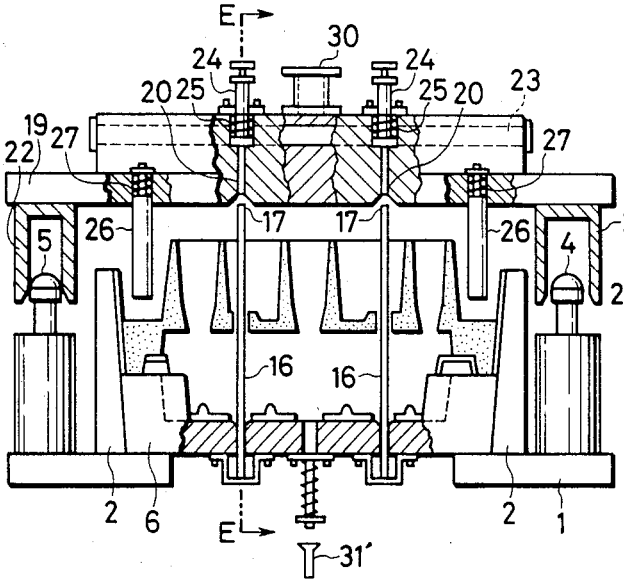
FIG. 10 is a partial exploded side view of the apparatus immediately before the tubular member and a cooling nozzle are fitted.
Figure 11:
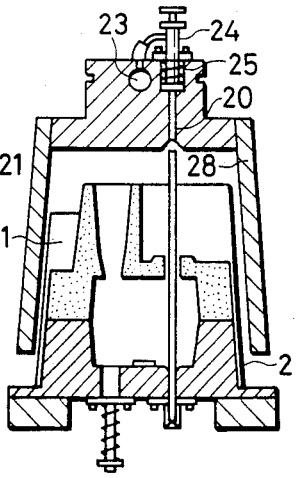
FIG. 11 is a sectional view taken along line E—E of FIG. 10.

In the drawing, reference numeral 28 of FIG. 9 represents an upper taper case which is disposed on the side surface of the cooling plate 19 and extends in its longitudinal direction. The upper taper case fits to, and is guided by, the downwardly expanding inclined surfaces of the taper cases 2, 3 disposed at both ends of the lower mold. In this case, the lateral width of the taper cases 2, 3 corresponding to the lateral width of the casting mold is a bit greater than that of the casting molds, so that the upper and lower molds do not undergo friction when the cooling plate 19 is set onto the stool 1 and the dropping of sand from the upper mold and wear of the lower mold do not occur. These taper cases 2, 3 and the upper taper case 28 completely cut off the leakage of molten metal from the joint surface between the upper and lower molds and the cooling plate. Reference numeral 31' in FIG. 10 represents a cooling medium jet device.

Figure 17:
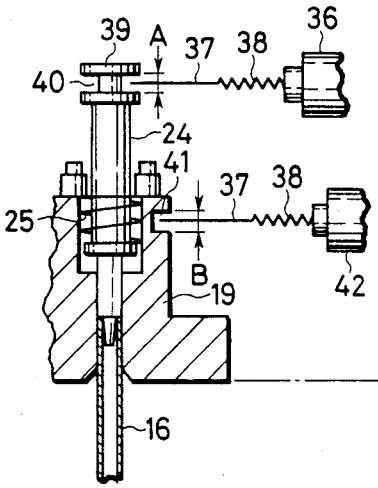
Figure 18:
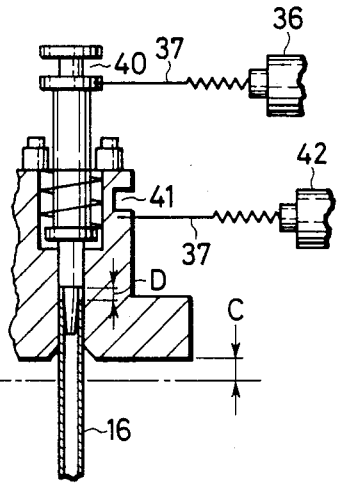
Figure 19:
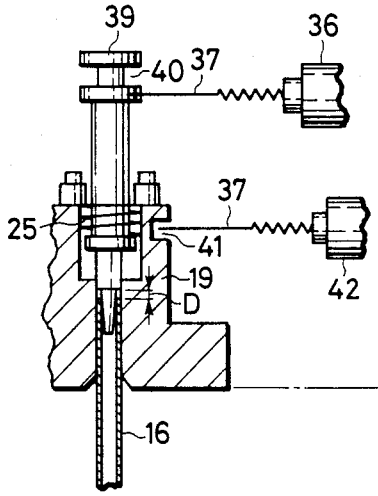
Figure 20:
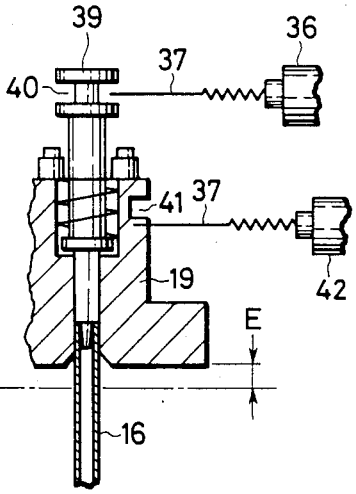

FIGS. 17 through 20 show the state in which the cooling plate 19 is set onto the stool and the tip of each cooling nozzle 24 is about to be inserted into the projecting end of each tubular member 16. FIG. 17 shows a normal insertion state, and FIGS. 18 through 20 shows the state in which an abnormality occurs. In the drawings, reference numeral 36 represents a limit type touch switch for the cooling nozzle, 37 is an antenna held by an antenna spring 38, 39 is an element equipped with a peripheral groove 40 and fixed to the cooling nozzle 24, and 41 is a groove formed at a suitable position of the cooling plate. Reference numeral 42 represents a limit type touch switch for the cooling plate 19. These limit switches 36 and 42 are for the cooling nozzle and for the cooling plate, respectively, and are set to the height corresponding to the circumferential groove 40 of the element 39 and the groove 41 of the cooling plate, respectively.

In other words, when these antennas can fit to the corresponding grooves, they detect the normal height of the cooling nozzle 24 and the cooling plate 19. The limit switches 36 and 42 are disposed on the casting line main body portion so that the antennas 37 pass through the circumferential groove 40 and the groove 41 after the cooling plate is set and sent to the next steps such as the molten metal pouring step and to the cooling station. In the state shown in FIG. 17, the antennas pass through the width A of the circumferential groove 40 and through the width B of the groove 41 so that the cooling plate and the cooling nozzle 24 are set normally. In FIG. 18, the cooling plate floats up from the casting mold by a distance C so that both antennas 37 are in contact with the members defining the groove, and an electric signal due to this contact causes a buzzer to sound. Moreover, an abnormality detection may be interlocked with means for interruption of the casting work. In FIG. 19, fitting between the tip of the cooling nozzle and the tubular member is shallower by a dimension D even if setting of the cooling plate is normal, and the next step is interrupted. Similarly, in FIG. 20, although the cooling nozzle is normally fitted to the tubular member, the cooling plate floats up by a dimension E so that the next step is interrupted.

Figure 15:
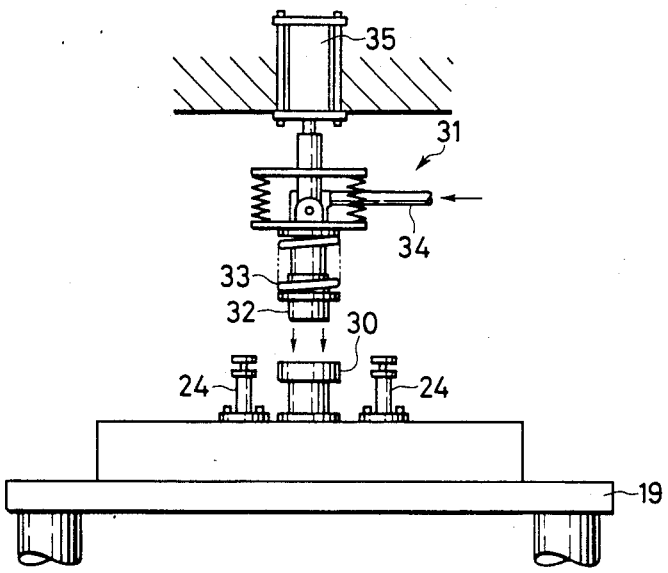
FIG. 15 is a side view of a cooling medium feeder.

Next, the operation of the embodiment having the construction described above will be described. The casting apparatus in accordance with the present invention is based upon the premise that necessary operations at each station are conducted while the casting apparatus is moved by rollers or along a track disposed below the stool. First of all, when the setting step between the upper and lower molds and the disposition of the tubular members 16 is completed as shown in FIG. 6, the cooling plate 19 provided in advance with a plurality of cooling nozzles is then set as shown in FIGS. 8 through 12. In this case, whether or not any abnormal fitting occurs between the cooling plate and the cooling nozzles 24 is detected by the abnormality detector for the cooling nozzles 24 shown in FIGS. 17 through 20. After the molten metal is poured, the cooling medium feeder 31 shown in FIG. 15 is lowered by the cylinder 35, and its orifice member 32 is connected to the cooling medium coupler 30.

When forced cooling of the casting mold is to be carried out, the cooling medium is jetted to the lower mold to cool it from jet 34' and through the punch-out of the stool 1 (shown by A in FIGS. 12 and 13) that supports thereon the lower mold. Water as the cooling medium is also caused to flow from the cooling medium feeder tube 34 through the cooling medium coupler, the cooling medium tube 23, the connection tube 29, the cooling nozzles 24 and the tubular members 16 so as to cool the molten metal, thereby causing directional solidification.

As described above, in order to shorten the casting cycle, the present invention conveys the casting apparatus using as the reference the molten metal pouring step which needs a short time within the production cycle. In consideration of the difference between the molten metal pouring time and the solidification time, the cooling is divided into steps at several stations to cause solidification. Therefore, a cooling medium feeder is disposed at each station, and the casting apparatus is fitted and removed whenever it is moved. In this case, since the cooling plate 19 is equipped with the cooling nozzles corresponding to a plurality of tubular members that are fitted into the mold, it is conveyed to each station, after pouring of the molten metal into the cavity, in the state shown in FIG. 12.

In the casting apparatus in accordance with the present invention, a plurality of tubular members are disposed in order to effectively cause directional solidification, particularly when casting large-scale castings. The fitting of the cooling nozzles 24 of the cooling plate 19 to the tubular members 16 is not within the visible range of an operator of the apparatus. If this fitting is not proper or if the cooling plate is not normally set onto the stool for some reason or other, the limit switches operate and stop the casting work. Therefore, the casting work can be done safely.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A forced cooling casting apparatus comprising:

a stool;

upper and lower molds disposed on said stool;

a plurality of tubular members disposed in such a manner as to penetrate through said upper and lower molds and through a cavity defined by said upper and lower molds; and a cooling plate disposed on said stool by guide members, said cooling plate being equipped with a plurality of nozzles for supplying a cooling medium, said nozzles fitting in upper ends of said tubular members, and with a cooling medium tube having a cooling medium coupler and communicating with said cooling nozzles; and abnormality detector means for sensing an abnormal setting of said cooling plate on said stool and an abnormal fitting of said cooling nozzles in said tubular members.

2. A forced cooling casting apparatus according to claim 1, wherein said abnormality detector includes limit type touch switches having antennas held at a first reference height of said cooling plate from said stool and at a second reference height of said cooling nozzles from said stool.

3. A forced cooling casting apparatus according to claim 2, including a first groove formed at said first reference height in a part of said cooling plate and a second circumferential groove formed at said second reference height on said cooling nozzle.

4. A forced cooling casting apparatus according to claim 2, wherein said switches include means for abnormality detection upon said antennas failing to pass through said first and second grooves.

5. A forced cooling casting apparatus comprising:

a stool having a punched out area at the center portion thereof;

upper and lower molds disposed on said stool;

a plurality of tubular members disposed in such a manner as to penetrate through said upper and lower molds and through a cavity defined by said upper and lower molds;

a cooling plate equipped with a plurality of cooling nozzles for supplying a cooling medium and fitted to upper ends of said tubular members, and cooling medium supply means communicating with said cooling nozzles; and cooling medium jet means for supplying a cooling medium jet for cooling said lower mold within said punched-out area of said stool.

6. A forced cooling casting apparatus comprising:

a stool;

upper and lower elongate molds disposed on said stool;

tubular members penetrating through said upper and lower molds and through a cavity defined by said upper and lower molds; and a cooling plate connected to said stool by guide means and equipped with cooling nozzles connected to means for supplying a cooling medium, said nozzles being fittable within the upper ends of said tubular members, wherein said means for supplying a cooling medium comprise a cooling medium coupler connectable to a source of cooling medium and a cooling medium tube communicated between said cooling nozzles and said cooling medium coupler.

7. A forced cooling casting apparatus according to claim 6, including a supporting bed for supporting the lower end of each of said tubular members.

8. A forced cooling casting apparatus according to claim 6, wherein said guide means consists of a pair of guide pins disposed at longitudinal end portions of said stool and a pair of bushes disposed below said cooling plate in such a manner as to correspond to said guide pins, wherein an engagement between one of said guide pins and bushes has a play in the longitudinal direction of said cooling plate.

9. A forced cooling casting apparatus according to claim 6, wherein said cooling plate has a mold support equipped with spring means for urging said mold support towards said upper mold, wherein said spring means is selected such that the total weight of said cooling plate is greater than the force of said spring means.

10. A forced cooling casting apparatus according to claim 6 wherein each of said cooling nozzles has spring means for urging said cooling nozzle in the direction of said tubular member, and wherein a tip portion of each said nozzle is disposed inside a taper portion of said cooling plate for guiding said tubular member, said taper portion being disposed around the periphery of an opening of a cooling nozzle hole of said cooling plate.

11. A forced cooling casting apparatus according to claim 6, including connection tube means for connecting said cooling medium tube to said cooling nozzles.

12. A forced cooling casting apparatus according to claim 6 including taper cases provided at longitudinal end portions of said lower mold for guiding said upper mold.

13. A forced cooling casting apparatus according to claim 12, wherein each of said taper cases has a downwardly expanding projection for guiding said upper mold.

14. A forced cooling casting apparatus according to claim 6 including fitting position locating means disposed on said upper mold and said lower mold.

15. A forced cooling casting apparatus according to claim 14 wherein said position locating means comprise a round dowel and a square dowel disposed on said lower mold, a round recess in said upper mold and a square recess in said upper mold for fitting said round and square dowels, respectively, said square recess being sized so as to have a play in the longitudinal direction of said upper mold when said square dowel is fitted therein.

* * * * *

UNITED STATES PATENT AND TRADEMARK OFFICE

CERTIFICATE OF CORRECTION

PATENT NO. : 4,671,337

DATED : June 9, 1987

INVENTOR(S) : Hiroshi Kawai, et al

It is certified that error appears in the above-identified patent and that said Letters Patent is hereby corrected as shown below:

Title page:

The Priority Information was not printed on the Letters Patent.
Should be as follows:

= Feb. 24, 1986 [JP] Japan ..... 61-38711 =

Signed and Sealed this

Seventeenth Day of November, 1987

*Attest:*

DONALD J. QUIGG

*Attesting Officer*

*Commissioner of Patents and Trademarks*